US008622238B1

(12) United States Patent
Kaper

(10) Patent No.: US 8,622,238 B1
(45) Date of Patent: Jan. 7, 2014

(54) ROTATABLE PULL-TAB ASSEMBLY

(76) Inventor: John Kaper, Hamilton, MI (US)

( * ) Notice: Subject to any disclaimer, the term of this patent is extended or adjusted under 35 U.S.C. 154(b) by 0 days.

(21) Appl. No.: 12/287,014

(22) Filed: Oct. 3, 2008

Related U.S. Application Data

(63) Continuation-in-part of application No. 12/079,705, filed on Mar. 28, 2008, now abandoned.

(51) Int. Cl.
*A47G 19/22* (2006.01)

(52) U.S. Cl.
USPC ..... 220/716; 220/254.4

(58) Field of Classification Search
USPC ..... 220/269, 270, 716, 718, 703, 704, 220/251.1, 254.4, 254.1
See application file for complete search history.

(56) References Cited

U.S. PATENT DOCUMENTS

| | | | | | |
|---|---|---|---|---|---|
| 3,372,832 | A | * | 3/1968 | Yeater et al. | 220/254.3 |
| 4,339,053 | A | | 7/1982 | Tarro | |
| 4,366,914 | A | | 1/1983 | Ingram | |
| 4,387,826 | A | * | 6/1983 | Heubl | 220/243 |
| 4,579,257 | A | * | 4/1986 | Brandlein | 222/192 |
| 4,715,510 | A | * | 12/1987 | van der Meulen et al. | 220/718 |
| 4,717,039 | A | | 1/1988 | Ayyoubi | |
| 4,752,016 | A | | 6/1988 | Eads | |
| 4,796,774 | A | | 1/1989 | Nabinger | |
| 4,842,159 | A | | 6/1989 | Heidrich | |
| 4,852,763 | A | | 8/1989 | Dimberio | |
| 4,869,389 | A | * | 9/1989 | Cerrone, Jr. | 220/713 |
| 4,880,136 | A | | 11/1989 | Englert | |
| 4,917,258 | A | * | 4/1990 | Boyd et al. | 220/240 |
| 4,938,379 | A | * | 7/1990 | Kellner | 220/370 |
| 4,961,510 | A | * | 10/1990 | Dvoracek | 220/713 |
| 5,054,640 | A | * | 10/1991 | Tucker | 220/716 |
| 5,062,552 | A | * | 11/1991 | Heubel | 222/570 |
| 5,080,249 | A | | 1/1992 | Shock | |
| 5,088,614 | A | * | 2/1992 | Dumestre | 220/713 |
| 5,176,278 | A | * | 1/1993 | Quarberg | 220/320 |
| 5,203,467 | A | * | 4/1993 | Tucker | 220/254.3 |
| 5,240,132 | A | * | 8/1993 | Tucker | 220/212 |
| 5,285,924 | A | | 2/1994 | Morris | |
| 5,353,942 | A | * | 10/1994 | Dominguez | 220/254.5 |
| 5,402,904 | A | * | 4/1995 | Close | 220/254.3 |
| 5,547,100 | A | * | 8/1996 | Johnson | 220/253 |
| 5,617,970 | A | * | 4/1997 | Lee | 220/730 |
| 5,720,408 | A | * | 2/1998 | Schmid et al. | 220/287 |
| 5,720,412 | A | * | 2/1998 | Ficken | 220/703 |
| 5,823,384 | A | * | 10/1998 | Sartori de Zamparolo | 220/717 |
| 5,845,801 | A | * | 12/1998 | Heitl | 220/269 |
| 5,984,127 | A | * | 11/1999 | Fenton | 220/254.1 |
| 6,073,797 | A | * | 6/2000 | Barous | 220/716 |
| 6,220,470 | B1 | * | 4/2001 | McHenry et al. | 220/254.4 |
| 6,588,617 | B1 | * | 7/2003 | Majcen et al. | 220/254.4 |

(Continued)

OTHER PUBLICATIONS

Office Action for U.S. Appl. No. 12/079,705 issued by USPTO on Nov. 20, 2008.

*Primary Examiner* — Anthony Stashick
*Assistant Examiner* — Christopher McKinley
(74) *Attorney, Agent, or Firm* — King & Partners, PLC

(57) ABSTRACT

A rotatable pull-tab assembly for a beverage container having a handle member which is displaceable from a storage position to a seal plate opening position, a seal plate opener which causes a seal plate of a beverage container to open upon displacement of the handle member, and a cover plate member which substantially covers an opening of a beverage container when the rotatable pull-tab assembly is in a closed position.

1 Claim, 6 Drawing Sheets

(56) References Cited

U.S. PATENT DOCUMENTS

| | | | | |
|---|---|---|---|---|
| 6,637,616 | B2 * | 10/2003 | Couto | 220/717 |
| 6,722,518 | B1 * | 4/2004 | Bartz | 220/254.4 |
| 6,755,315 | B1 * | 6/2004 | Mueller | 220/254.4 |
| 7,017,769 | B1 * | 3/2006 | Talmon | 220/258.2 |
| 7,152,753 | B2 * | 12/2006 | Huffman et al. | 220/254.4 |
| 2002/0070219 | A1 * | 6/2002 | Song | 220/254.4 |
| 2002/0117499 | A1 * | 8/2002 | Hur | 220/254.4 |
| 2003/0000952 | A1 * | 1/2003 | Dyren | 220/254.4 |
| 2004/0094550 | A1 * | 5/2004 | Poole | 220/254.4 |
| 2004/0256388 | A1 * | 12/2004 | Rossetti et al. | 220/254.4 |
| 2005/0051553 | A1 * | 3/2005 | Li et al. | 220/254.4 |
| 2005/0211708 | A1 * | 9/2005 | Thomas | 220/258.2 |
| 2005/0236411 | A1 * | 10/2005 | Huffman et al. | 220/254.4 |
| 2006/0043092 | A1 * | 3/2006 | Alfonso | 220/254.4 |
| 2007/0051725 | A1 * | 3/2007 | Glade | 220/254.4 |
| 2007/0131690 | A1 * | 6/2007 | Gavino Nadal | 220/254.4 |
| 2007/0138178 | A1 * | 6/2007 | Erickson | 220/254.4 |
| 2007/0145055 | A1 * | 6/2007 | Gardiner | 220/254.4 |

* cited by examiner

ROTATABLE PULL-TAB ASSEMBLY

CROSS-REFERENCE TO RELATED APPLICATION(S)

This application is a continuation-in-part of U.S. application Ser. No. 12/079,705, filed Mar. 28, 2008 now abandoned, entitled "ROTATABLE PULL-TAB ASSEMBLY," which is hereby incorporated herein by reference in its entirety—including all references cited therein.

BACKGROUND OF THE INVENTION

1. Field of the Invention

The present invention relates in general to a pull-tab assembly and, more particularly, to a rotatable pull-tab assembly which substantially reseals a dispensing aperture of a beverage container to, in turn, preserve and/or retain the contents therein.

2. Background Art

Pull-tab assemblies have been known in the art for years. While conventional pull-tab assemblies have been known in the art, issues relative to the resealability of the dispensing aperture associated with beverage containers remains largely problematic. In particular, to the best of Applicant's knowledge, traditional beverage containers do not provide means for resealing the dispensing aperture, thereby exposing any beverage contained therein to outside contaminates such as insects and/or debris. To be sure, the inability to reseal and/or cover the dispensing aperture may have substantially adverse implications for individuals who are susceptible to allergic reactions from insect bites and/or stings—including anaphylactic shock and, in some cases, death.

Additionally, beverage containers are frequently wasted when one of the following occurs: (1) the contents in the beverage container loses carbonation; (2) the beverage container loses some or all of its contents via a spill; and/or (3) the contents in the beverage container becomes contaminated through exposure of the same via the dispensing aperture.

It is therefore an object of the present invention to provide a rotatable pull-tab assembly that, among other things, remedies and/or minimizes the aforementioned detriments and/or complications associated with conventional pull-tab assemblies and containers having the same.

These and other objects of the present invention will become apparent in light of the present specification, claims, and drawings.

SUMMARY OF THE INVENTION

In one embodiment, the present invention is directed to a rotatable pull-tab assembly for a beverage container, comprising: (a) a handle member, wherein the handle member is displaceable from a storage position to a seal plate opening position; (b) a seal plate opener, wherein the seal plate opener is positioned opposite the handle member, and wherein the seal plate opener causes a seal plate of a beverage container to open upon displacement of the handle member to the seal plate opening position; (c) a cover plate member, wherein the cover plate member is positioned below the handle member, and wherein the cover plate comprises an outer peripheral geometry greater than that of the handle member, and further wherein the cover plate member comprises an aperture having an inner surface which contacts a post of a beverage container; (d) wherein the rotatable pull-tab assembly is rotatable from an initial position to a closed position about a post of a beverage container; and (e) wherein the cover plate member substantially covers an opening of a beverage container when the rotatable pull-tab assembly is in the closed position.

In a preferred embodiment of the present invention, the handle member and the seal plate opener comprise a unitary member.

In another preferred embodiment of the present invention, the handle member comprises an aperture that is adapted to receive at least a portion of a user's finger.

In yet another preferred embodiment of the present invention, the handle member and the cover plate member form an acute angle when the handle member is in the storage position.

In another aspect of the present invention, the cover plate member comprises a substantially semi-circular geometry.

In one preferred embodiment of the present invention, the cover plate member comprises an outer peripheral geometry that is greater than the outer peripheral geometry of an opening of an associated beverage container.

In a preferred embodiment of the present invention, the cover plate comprises a leading edge, wherein the leading edge is configured to be received within a lip groove of an associated beverage container.

In another preferred embodiment of the present invention, the leading edge of the cover plate comprises a cleaning member, wherein the cleaning member is configured to substantially remove debris from a lip groove of an associated beverage container.

In yet another preferred embodiment of the present invention, the rotatable pull-tab assembly further comprises a cover plate displacement member, wherein the cover plate displacement member is associated with an upper surface of the cover plate member.

In another aspect of the present invention, the rotatable pull-tab assembly is rotatable from an initial position to a closed position about a post of an associated beverage container via operation of the cover plate displacement member.

In one preferred embodiment of the present invention, the cover plate member further comprises a lower surface having a secondary seal member.

In a preferred embodiment of the present invention, at least a portion of the secondary seal member contacts at least a portion of an inner surface of a top wall of an associated beverage container.

In another preferred embodiment of the present invention, the secondary seal member comprises a suction cup member which provides a substantially hermetic seal around an opening of an associated beverage container.

In yet another preferred embodiment of the present invention, the secondary seal member comprises at least one of a natural rubber, a silicone rubber, and/or a siloxane polymer.

In another aspect of the present invention, the top wall and/or edge wall includes a bump and/or protrusion to facilitate frictional securement of the cover plate member while in the engaged and/or closed position.

In one embodiment, the present invention is also directed to a beverage container, comprising: (a) a top wall, (b) a bottom wall, and (c) a side wall, wherein the top wall, the bottom wall, and the side wall form a cavity for containing a beverage therein; and wherein the top wall comprises: (1) a post; (2) a severable score line, wherein the severable score line defines a seal plate; and (3) a rotatable pull-tab assembly as is disclosed in the present invention.

BRIEF DESCRIPTION OF THE DRAWINGS

Certain embodiments of the present invention are illustrated by the accompanying figures. It will be understood that the figures are not necessarily to scale and that details not necessary for an understanding of the invention or that render other details difficult to perceive may be omitted. It will be understood that the invention is not necessarily limited to the particular embodiments illustrated herein.

The invention will now be described with reference to the drawings wherein.

DETAILED DESCRIPTION OF THE INVENTION

Figure 1:
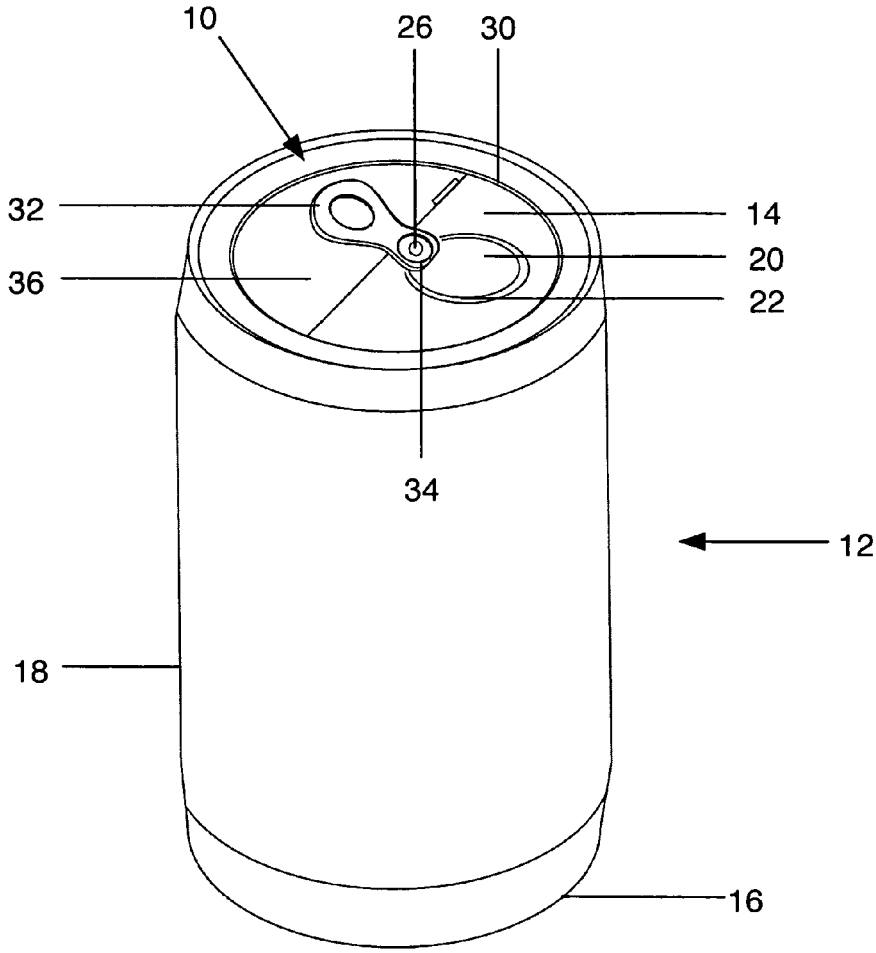
FIG. 1 of the drawings is a perspective view of a rotatable pull-tab assembly and associated beverage container according to the present invention (Initial/Storage Position)

While this invention is susceptible of embodiment in many different forms, there is shown in the drawings and described herein in detail several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings with like reference characters.

Referring now to the drawings, and to FIG. 1 in particular, a perspective view of rotatable pull-tab assembly 10 and associated beverage container 12 is shown in an initial position. Beverage container 12 is shown as generally comprising top wall 14, bottom wall 16 and side wall 18. Top wall 14, bottom wall 16, and side wall 18 form a cavity for containing a beverage therein.

In accordance with the present invention, top wall 14 is configured to receive rotatable pull-tab assembly 10. Top wall 14 is shown as comprising, among other components, seal plate 20 and severable score line 22. The outer peripheral geometry of seal plate 20 is defined by severable score line 22. Severable score line 22 terminates short of a complete geometrical shape to provide hinged area 24 (see FIG. 2) to one side of post 26 by which the rotatable pull-tab assembly 10 is rotatably and pivotally secured to top wall 14. It will be understood that when severable score line 22 is ruptured, it creates opening and/or dispensing aperture 28 (see FIG. 2) which allows a beverage to be dispensed from beverage container 12. Top wall 14 also preferably comprises lip groove 30. Lip groove 30 provides a reservoir for retaining excess beverage not consumed when a user drinks from beverage container 12.

Figure 2:
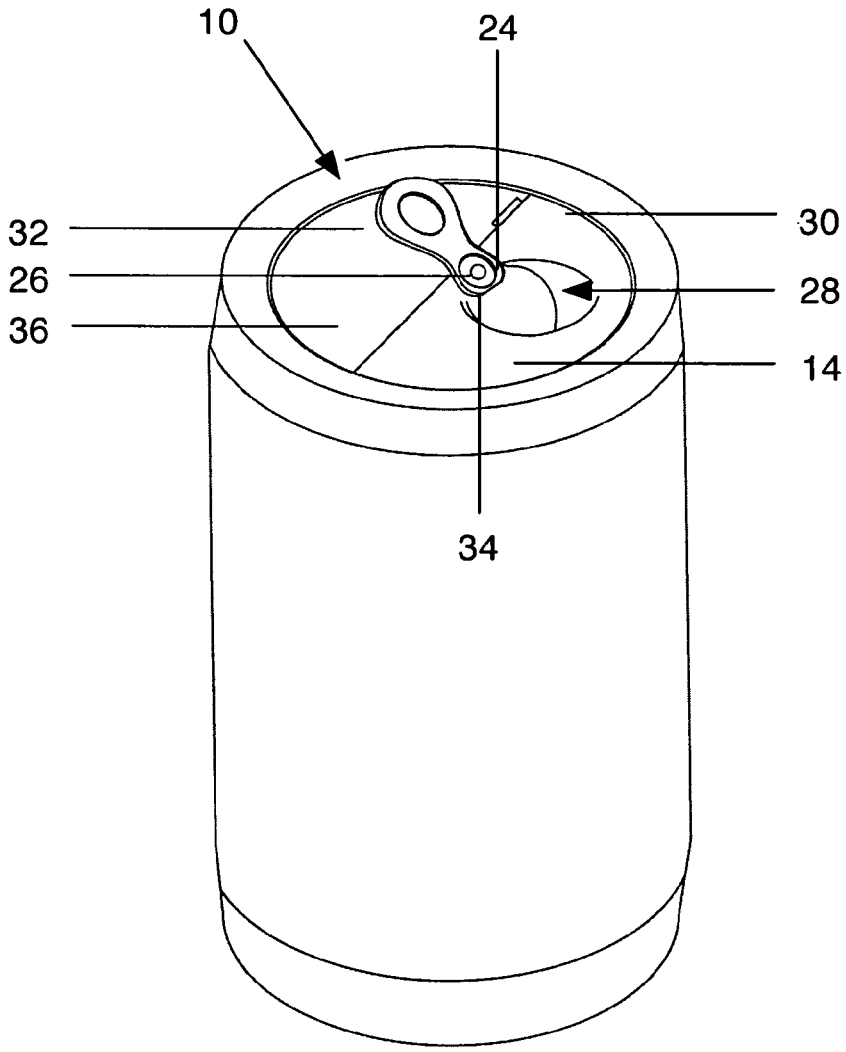
FIG. 2 of the drawings is a perspective view of a rotatable pull-tab assembly and associated beverage container according to the present invention (Seal Plate Opening Position)

Referring now to FIGS. 1 and 2 collectively, rotatable pull-tab assembly 10 is shown as comprising, handle member 32, seal plate opening member 34, and cover plate member 36.

In one embodiment, handle member 32 is generally displaceable between two positions, namely: an initial, storage (pre-opening) position, and a seal plate opening position. In the storage position, seal plate opening member 34 is shown as overlying top wall 14 preferably within the boundary of both severable score line 22 and seal plate 20. Also, handle member 32 is shown as extending over top wall 14 at a location remote from seal plate 20. For purposes of the present disclosure, handle member 32 and seal plate opening member 34 are shown as preferably comprising a unitary member and operate as a simple lever about a point where seal plate opening member 34 and cover plate member 36 intersect during construction.

It will be understood that displacing handle member 32 upwardly to the seal plate opening position will cause seal plate opening, member 34 to displace downwardly and rupture severable score line 22.

Figure 3A:
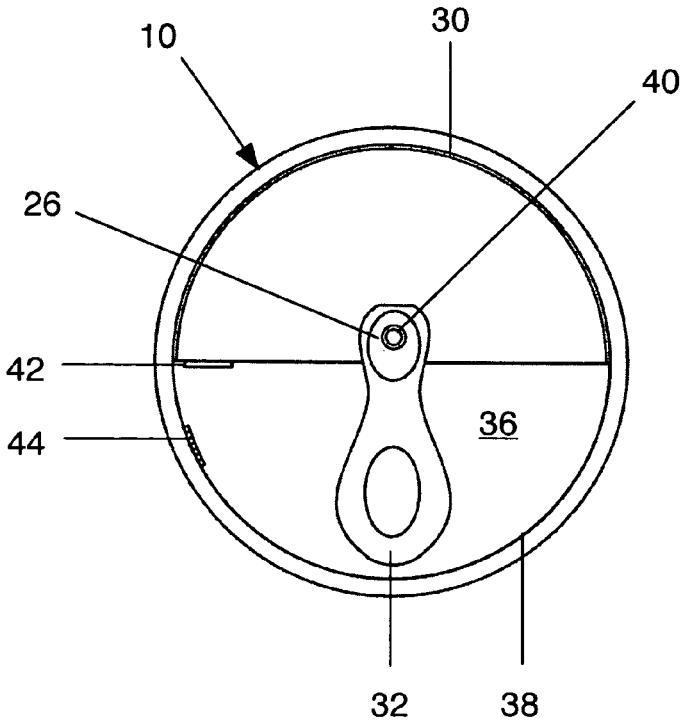
FIG. 3A of the drawings is a top plan view of a rotatable pull-tab assembly and associated beverage container according to the present invention (Closed Position)

Referring now to FIG. 3A, a top plan view of rotatable pull-tab assembly 10 is shown associated with a beverage container. Cover plate member 36 is shown as associated with top wall 14 via post 26. Cover plate member 36 further comprises leading edge 38, aperture 40, and optional cover plate displacement member 42. Cover plate member 36 is positioned below handle member 32 (see FIG. 4A) and operates to substantially cover opening 28 when rotatable pull-tab assembly 10 is in the closed position. It will be understood that in order to facilitate the covering of opening 28, the outer peripheral geometry of cover plate member 36 will preferably be greater than the outer peripheral geometry of handle member 32 and/or the outer peripheral geometry of opening 28.

Figure 3B:
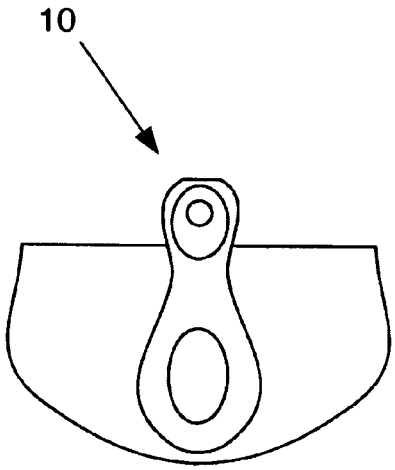
FIGS. 3B-C of the drawings are top plan views of rotatable pull-tab assemblies according to the present invention.
Figure 3C:
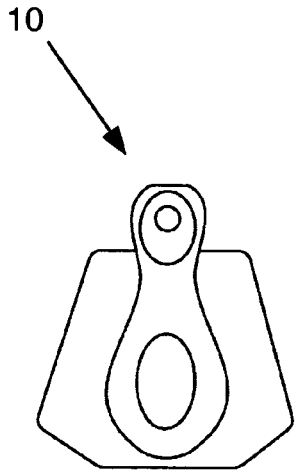

Cover plate member 36 may comprise a semi-circular geometrical plate which substantially covers at least one half of top wall 14 of an associated beverage container. Alternatively, and as is best shown in FIGS. 3B and 3C, cover plate member 36 may comprise any one of a number of geometries (e.g. substantially circular, hexagonal, elliptical, and/or polygonal—just to name a few) so long as cover plate member 36 has an outer peripheral geometry that generally conforms to and/or is greater than that of opening 28 of top wall 14.

In accordance with the present invention, cover plate member 36 preferably comprises leading edge 38, which is, in certain embodiments, preferably fabricated to mate geometrically with lip groove 30. In a preferred embodiment of the present invention, lip groove 30 comprises cleaning member 44. Cleaning member 44 preferably cleans, removes, and/or clears debris from lip groove 30. To aid in removal of debris from lip groove 30, cleaning member 44 may preferably comprise, for example, a brush with bristles, a sponge, a foam pad, a textile, a resin or polymer, etceteras.

Figure 4A:
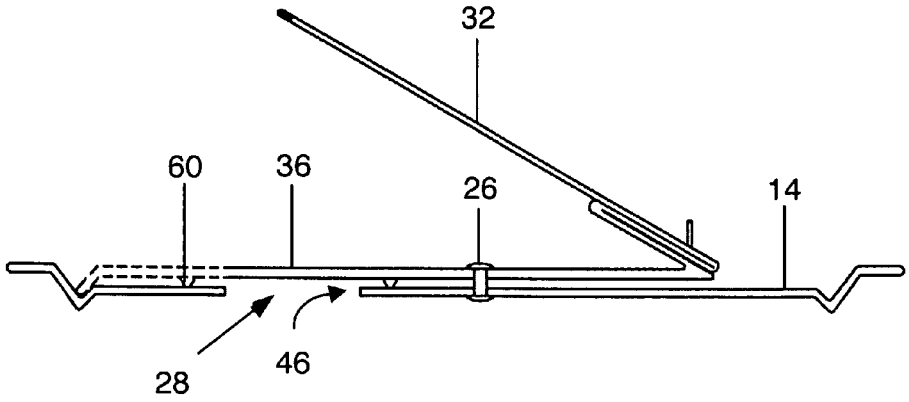
FIG. 4A of the drawings is a fragmented, cross sectional representation of a rotatable pull-tab assembly having a secondary seal member associated with the top wall of a beverage container, according to the present invention.

Referring now to FIG. 4A, a cross sectional view of cover plate member 36 is shown as further comprising secondary seal member 46 associated with top wall 14. In accordance with the present disclosure, secondary seal member 46 is shown as secured to the lower surface of cover plate member 36 via any one of a number of fasteners, including screws, bolts, nails, pins, anchors, rivets, and/or adhesives or bonding agents—just to name a few.

In this embodiment, secondary seal member 46 preferably comprises suction cup 60 which engages around opening 28 and preferably creates a substantially hermetic seal thereby preserving the contents therein. Advantages of such a secondary seal, among others, include preserving carbonation in a beverage, preventing possible contamination and/or loss of the beverage.

Figure 4B:
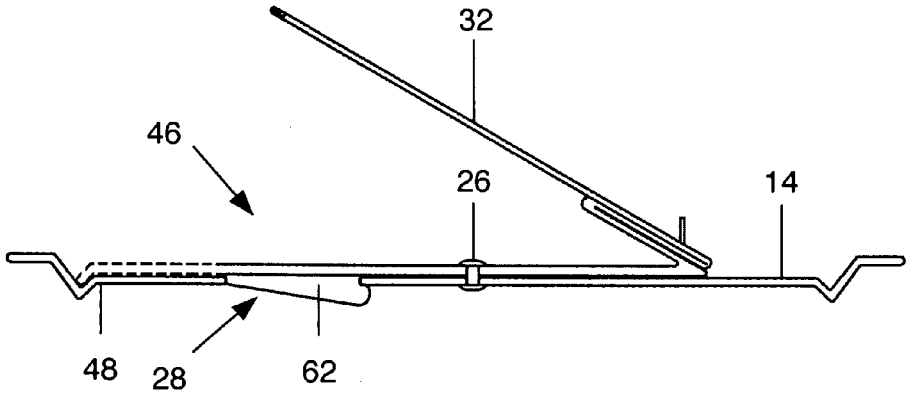
FIG. 4B of the drawings is a fragmented, cross sectional representation of a rotatable pull-tab assembly having a secondary seal member associated with the top wall of a beverage container, according to the present invention.

Referring now to FIG. 4B, a cross sectional view of an alternative embodiment of secondary seal member 46 is shown as comprising plug 62. Plug 62 preferably fits into opening 28 and preferably contacts at least a portion of inner surface 48 of top wall 14. It will be understood that this embodiment also acts to create a substantially hermetic seal preserving the contents therein. Plug 62 preferably comprises, for example, a section of natural rubber, silicone rubber, and/or a siloxane polymer. It will be understood that siloxane polymers which are commercially available from Dow Corning (Midland, Mich.) are particularly preferred because of their functional characteristics.

Figure 4C:
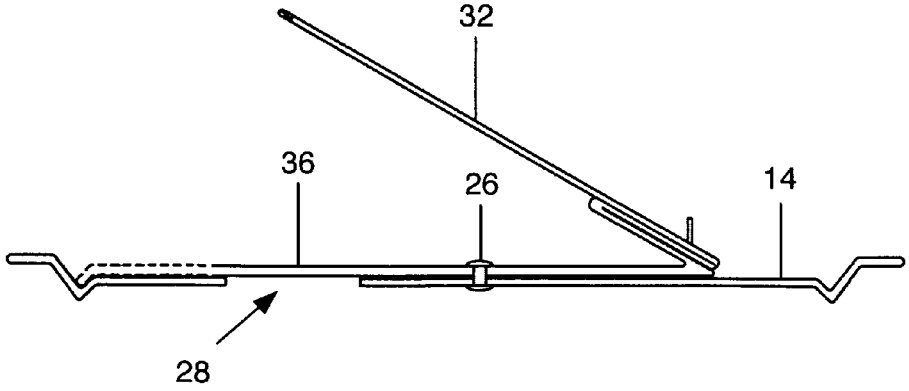
FIG. 4C of the drawings is a fragmented, cross sectional representation of a rotatable pull-tab assembly without a secondary seal member associated with the top wall of a beverage container, according to the present invention.

Referring now to FIG. 4C, a cross sectional view of an alternative embodiment of the present invention is shown as comprising cover plate member 36 without secondary seal member 46. In this embodiment, cover plate member 36 overlies and is preferably biased against opening 28 to substantially cover the same. It will be understood that cover plate member 36 may extend to lip groove 30, or merely extend past aperture 28, as is shown in dashed lines in FIG. 4C. It will be further understood that such a variable dimension is applicable to all embodiments provided in the present invention, including, but not limited to, those provided in FIGS. 4A and 4B.

Other alternative embodiments may include, but are not limited to, cover plate member 36 having secondary seal member 46 which may comprise, for example, a substrate of sealing material (i.e. natural rubber, silicone rubber, and/or siloxane polymer), or a ring of sealing material.

Figure 5:
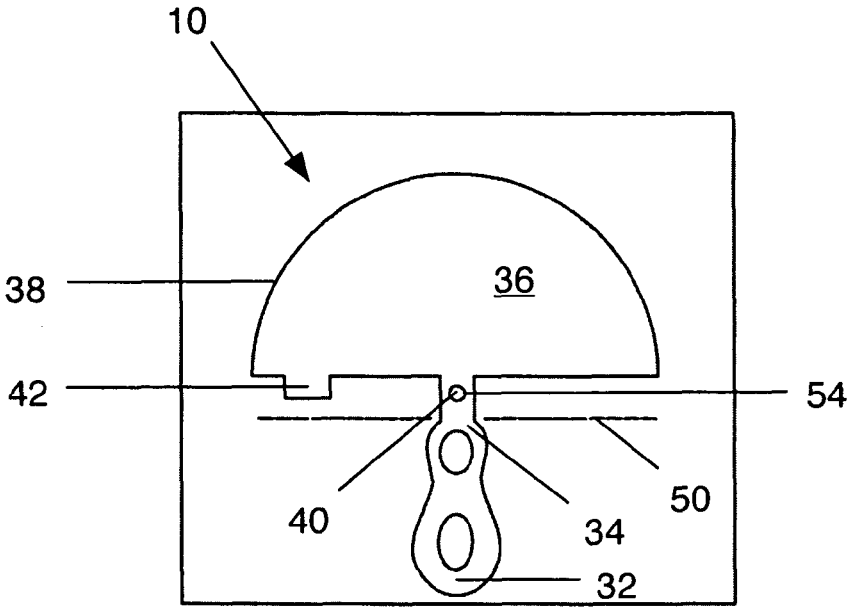
FIG. 5 of the drawings is a top plan view of a piece of sheet metal having a die cut pattern for a rotatable pull-tab assembly according to the present invention.

Referring now to FIG. 5, a top plan view of a piece of sheet metal is shown having a die cut pattern for a rotatable pull-tab assembly. By way of non-limiting example, to construct rotatable pull-tab assembly 10, a piece of sheet metal is die cut to the appropriate pattern and formed to correspond to the desired shape and size. It will be understood that the pattern used to manufacture rotatable pull-tab assembly 10 will vary depending on the type of beverage container it will be associated with.

Figure 6:
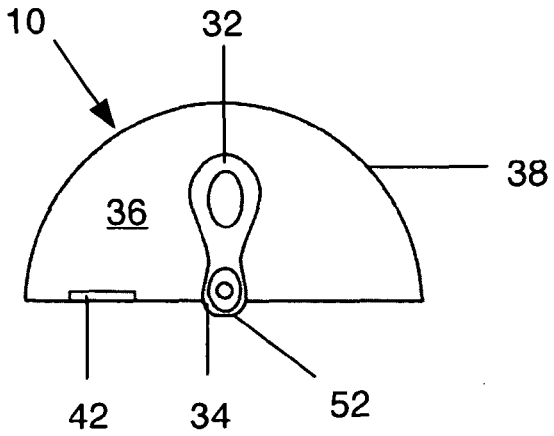
FIG. 6 of the drawings is a top plan view of a rotatable pull-tab assembly constructed in accordance with the present invention.
Figure 7:
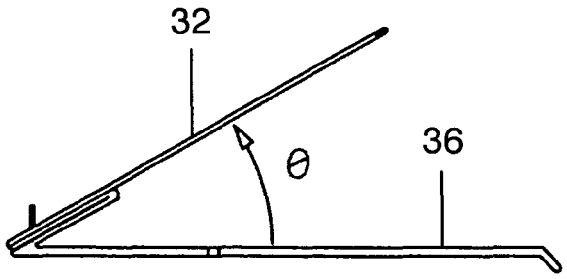
FIG. 7 of the drawings is a fragmented, cross sectional view of an acute angle formed during construction of a rotatable pull-tab assembly in accordance with the present invention.

Referring now to FIGS. 5 and 6 collectively, a top plan view of a rotatable pull-tab assembly 10 is shown. To reinforce handle member 32 and seal opening member 34, the sheet metal may be bent upon itself to form a double thickness. This double thickness extends continuously around handle member 32 and seal opening member 34. The sheet metal is preferably bent about line 50 during the creation of the double thickness around front edge 52 of seal plate opening member 34. This allows leading edge 38 of cover plate member 36 to extend in the direction of handle member 32 and simultaneously creates an acute angle θ (see FIG. 7) between handle member 32 and cover plate member 36. Also, the end of leading edge 38 is preferably bent to correspond a lip groove of an associated beverage container.

Cover plate member 36 will also preferably be constructed with cover plate displacement member 42. Cover plate displacement member 42 is shown as comprising a vertical tab fabricated into a side of cover plate member 36. It will be understood that cover plate displacement member 42 is adapted to be grasped by a user to displace rotatable pull-tab assembly 10 from an initial position (see FIG. 1) to a closed position (see FIG. 3). To reinforce cover plate displacement member 42, the sheet metal is bent upon itself to form a double thickness. It will also be understood that cover plate displacement member 42 may also preferably be a separate structure attached to the upper surface of cover plate member 36.

To secure rotatable pull-tab assembly 10 to an associated beverage container aperture 40 is die cut into cover plate member 36. Aperture 40 comprises an inner surface 54 which contacts a post of an associated beverage container.

As is best shown in FIG. 4A, post 26 may comprise, for example, a rivet, or a single post with a head. However, any one of a number of structures that would be known to one of ordinary skill in the art having the present disclosure before them are likewise contemplated for use in accordance with the present invention.

Figure 8:
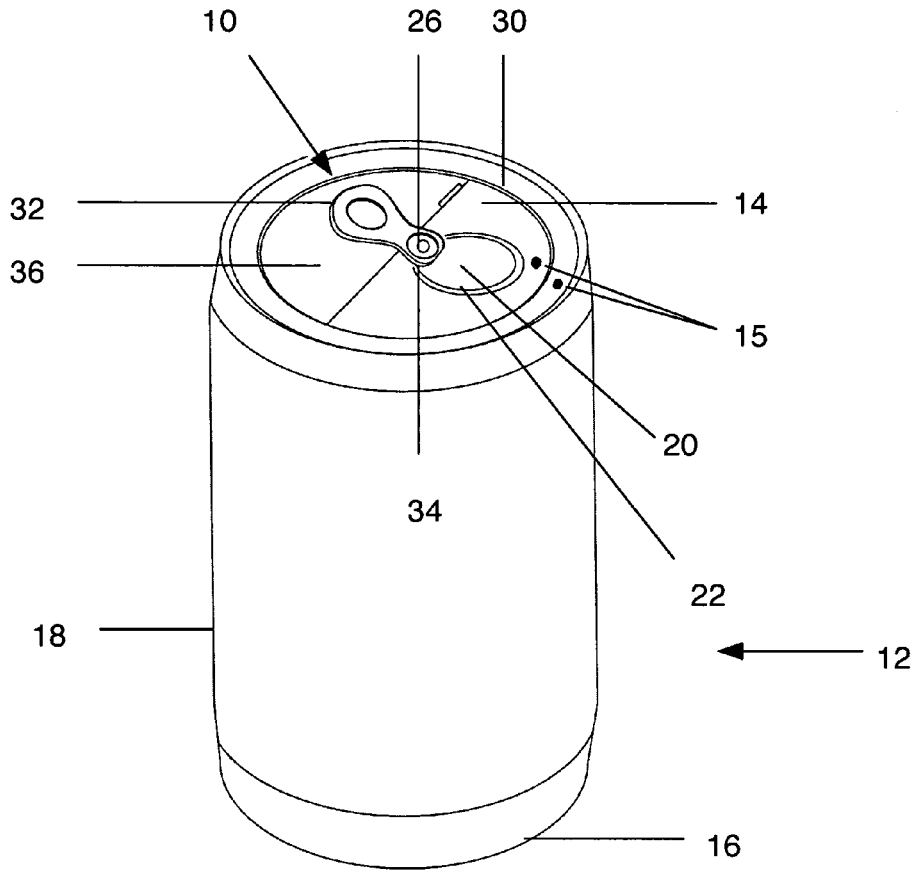
FIG. 8 of the drawings is a perspective view of a rotatable pull-tab assembly and associated beverage container according to the present invention showing, among other things, a bump and/or protrusion to facilitate frictional securement of the cover plate member.
Figure 9:
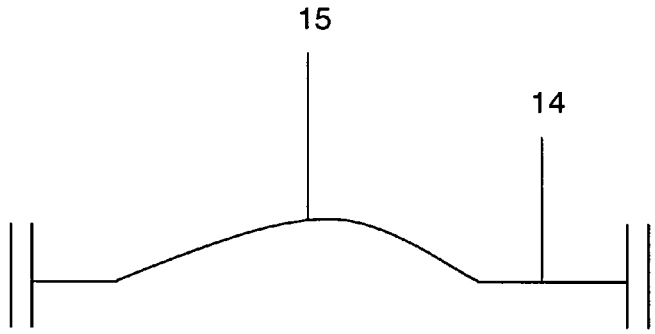
FIG. 9 of the drawings is a fragmented, cross sectional view of a protrusion associated with the top wall of the beverage container.

Referring now to FIGS. 8 and 9, collectively, top wall 14 and/or edge wall of the beverage container may also include one or more bump(s) and/or protrusion(s) 15, which facilitate frictional securement of cover plate member 36 while in the engaged and/or closed position. It will be understood that one or more protrusion(s) 15 are preferably placed near and/or around (e.g. proximate) aperture 28.

In operation, a user either grasps handle member 32 or inserts a portion of their finger into handle member 32. A user then displaces handle member 32 upward from a storage position to a seal opening position, pivoting seal plate opening member 34 downwardly. The downward displacement of seal plate opening member 34 ruptures severable score line 22 creating opening 28. In order to reseal opening 28, a user grasps or simply pushes at least one of handle member 32, cover plate member 36, and cover plate displacement member 42, rotatably displacing cover plate member 36 and, in turn, rotatable pull-tab assembly 10 from an initial position, to a closed position. During displacement, optional cleaning member 44 of cover plate member 36 preferably removes dirt and/or debris residing in lip groove 30.

When the rotatable pull-tab assembly 10 is in the closed position, cover plate member 36 and/or secondary seal member 46 is positioned above opening 28. The upper surface of cover plate is then depressed to engage secondary seal member 46 (if present) and create a substantially hermetic seal around and/or with opening 28 preserving the carbonation of the contents therein. Also, engagement of cover plate member 36 and opening 28 operates to substantially preclude loss and/or contamination of the contents of the beverage container.

It will be understood that the present invention pertains to containers that comprise food products, fruits, vegetables, liquids, solids, gases, etceteras, and that the term beverage as used herein is interchangeable with the same.

The foregoing description merely explains and illustrates the invention and the invention is not limited thereto except insofar as the appended claims are so limited, as those skilled in the art who have the disclosure before them will be able to make modifications without departing from the scope of the invention.

What is claimed:

1. A beverage container, consisting of:

a top wall, a bottom wall, and a side wall, and an annular lip having a top surface, wherein the top wall, the bottom wall, and the side wall form a cavity for containing a beverage therein; and wherein the top wall comprises: a protrusion having a top surface; a post; and a severable score line; and wherein the severable score line defines a seal plate; and further wherein the top surface of the protrusion on the top wall is positioned below the top surface of the annular lip; and a rotatable pull-tab assembly comprising:

a handle member, wherein the handle member is displaceable from a storage position to a seal plate opening position;

a seal plate opener, wherein the seal plate opener is positioned opposite the handle member, and wherein the seal plate opener causes a seal plate of a beverage container to open upon displacement of the handle member to the seal plate opening position;

a cover plate member having a bottom surface and an inner surface which contacts a post of a beverage container;

wherein the rotatable pull-tab assembly is rotatable from an initial position to a closed position about a post of a beverage container;

wherein the cover plate member substantially covers an opening of a beverage container when the rotatable pull-tab assembly is in the closed position;

wherein the protrusion is disposed proximate the opening of the beverage container such that only when the cover plate member of the rotatable pull-tab assembly is rotated to the closed position, the top surface of the protrusion contactingly engages the bottom surface of the cover plate member to secure the same in the closed position;

wherein the handle member comprises an aperture which is adapted to receive at least a portion of a user's finger;

wherein the handle member and the cover plate member form an acute angle when the handle member is in the storage position;

wherein the cover plate member comprises a substantially semi-circular geometry;

wherein the cover plate member comprises an outer peripheral geometry which is greater than the outer peripheral geometry of an opening of an associated beverage container;

wherein the cover plate member comprises a leading edge, wherein the leading edge is configured to be received within a lip groove of the beverage container and wherein the leading edge of the cover plate member comprises a cleaning member, and wherein the cleaning member is configured to substantially remove debris from a lip groove of the beverage container;

wherein the rotatable pull-tab assembly further comprises a cover plate displacement member, wherein the cover plate displacement member is associated with an upper surface of the cover plate member, and wherein the rotatable pull-tab assembly is rotatable from an initial position to a closed position about the post of the beverage container via operation of the cover plate displacement member; and wherein the bottom surface of the cover plate member further comprises a secondary seal member, and wherein at least a portion of the secondary seal member contacts at least a portion of an inner surface of the top wall of the beverage container, and further wherein the secondary seal member comprises a suction cup member which provides a substantially hermetic seal around an opening of the beverage container, and wherein the secondary seal member comprises at least one of a silicone and a siloxane polymer.

* * * * *